US011767680B2

(12) United States Patent
van Kleef et al.

(10) Patent No.: US 11,767,680 B2
(45) Date of Patent: Sep. 26, 2023

(54) DEPLOYABLE MANUFACTURING PRODUCTION FACILITY AND METHOD

(71) Applicants: Ericus Andreas van Kleef, Simpsonville, KY (US); Robert F. Hull, Beaufort, SC (US)

(72) Inventors: Ericus Andreas van Kleef, Simpsonville, KY (US); Robert F. Hull, Beaufort, SC (US)

( * ) Notice: Subject to any disclaimer, the term of this patent is extended or adjusted under 35 U.S.C. 154(b) by 39 days.

(21) Appl. No.: 17/677,267

(22) Filed: Feb. 22, 2022

(65) Prior Publication Data

US 2022/0268046 A1 Aug. 25, 2022

Related U.S. Application Data

(60) Provisional application No. 63/152,657, filed on Feb. 23, 2021.

(51) Int. Cl.

| | |
|---|---|
| ***E04H 5/02*** | (2006.01) |
| ***B66C 17/20*** | (2006.01) |
| ***E04H 15/18*** | (2006.01) |
| ***E04B 1/342*** | (2006.01) |

(52) U.S. Cl.

CPC ..... *E04H 5/02* (2013.01); *B66C 17/20* (2013.01); *E04B 1/342* (2013.01); *E04H 15/18* (2013.01)

(58) Field of Classification Search

CPC ..... E04H 5/02; E04H 15/18; B66C 17/20; B66C 17/00; E04B 1/342

See application file for complete search history.

(56) References Cited

U.S. PATENT DOCUMENTS

| | | | | | |
|---|---|---|---|---|---|
| 1,835,859 | A * | 12/1931 | French | B66C 17/20 | 104/103 |
| 1,879,607 | A * | 9/1932 | Fitch | B66C 17/20 | 212/324 |
| 2,069,235 | A * | 2/1937 | Fitch | B66C 17/20 | 248/694 |
| 3,961,712 | A * | 6/1976 | Bartley | B66C 17/00 | 212/315 |
| 4,641,757 | A * | 2/1987 | Rosendale | B66C 9/00 | 212/346 |
| 4,773,191 | A * | 9/1988 | Slack | E04B 1/3205 | 52/63 |
| 5,495,956 | A * | 3/1996 | Arnold | B64F 5/10 | 212/346 |
| 11,236,519 | B2 * | 2/2022 | Bellissimo | E04B 2/56 | |
| 2002/0129566 | A1 * | 9/2002 | Piccolo | E04H 5/02 | 52/143 |
| 2008/0022609 | A1 * | 1/2008 | Franco | B28B 7/082 | 52/83 |
| 2011/0238208 | A1 * | 9/2011 | Kleine | B66C 13/48 | 700/218 |

(Continued)

*Primary Examiner* — Gisele D Ford
(74) *Attorney, Agent, or Firm* — Gary K. Price

(57) ABSTRACT

A deployable production facility may be used to produce building modules for use in the construction of buildings, and may be capable of later being redeployed at other locations. A frame is removably mounted to a production floor and is used to support one or more overhead cranes that are positioned over one or more production lines defined on the production floor, and a tent, is used to enclose the production line(s), frame and overhead cranes. As desired, the tent, overhead cranes and frame may be disassembled and redeployed at a different site.

17 Claims, 8 Drawing Sheets

(56) References Cited

U.S. PATENT DOCUMENTS

| | | | | |
|---|---|---|---|---|
| 2014/0123574 | A1* | 5/2014 | Paone | E04H 1/005 52/79.12 |
| 2018/0106031 | A1* | 4/2018 | Coombes | B66C 17/00 |
| 2018/0238043 | A1* | 8/2018 | Kuramoto | A01G 9/227 |
| 2018/0251292 | A1* | 9/2018 | Marchini | E04H 5/04 |
| 2022/0003017 | A1* | 1/2022 | Rohe | H04L 63/102 |

* cited by examiner

DEPLOYABLE MANUFACTURING PRODUCTION FACILITY AND METHOD

CROSS REFERENCES TO RELATED APPLICATIONS

U.S. Provisional Application for Patent No. 63/152,657, filed Feb. 23, 2021, with tide "Deployable Manufacturing Production Facility and Method" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not applicable.

BACKGROUND

Building construction, particularly residential building construction such as for single-family homes, has traditionally been a relatively slow and inefficient process that has generally been resistant to many of the automation techniques that have been applied to other industries. Many residential developments of single-family homes, for example, involve different general contractors, who rely in turn on different sub-contractors and tradesmen to construct individual buildings on-site and from the ground up. General contractors may compete for access to better sub-contractors and tradesmen, and the inaccessibility of a sub-contractor or tradesman to work on one project may stall that project while that sub-contractor or tradesman works on a different project. Construction materials are generally ordered and delivered for each project individually, and there is often little coordination between projects, even for those managed by the same general contractor. Nonetheless, most residential developments are constructed and managed by a single developer and require a large effort in organizing and coordination of materials and manpower; and, in most cases each home is, in the e constructed wholly on-site, one by one, and is still often subject to delays due to weather, delivery of materials, and availability of tradesmen.

Attempts have been made to automate some aspects of building construction. Manufactured or modular building techniques, for example, are increasingly used in building construction, and generally rely on building modules that are constructed in a permanent production facility, transported to the site, and assembled together on-site. Greater efficiencies are often realized due to the ability to centralize materials and manpower at a single location, resulting in reduced costs and improved consistency and quality in many instances.

However, production facilities are generally expensive to build, and siting such production facilities to service a large enough market that can justify the capital costs. Transportation costs getting modules to the building site are substantial, and can have an appreciable effect on the economic feasibility of some residential developments, particularly when building modules need to be transported on public roads for tens or hundreds of miles. Furthermore, a larger production facility necessarily supports as many customers as possible, so a developer or general contractor is still effectively competing with other developers and general contractors for production resources.

Therefore, a significant need continues to exist in the art fora more efficient and cost effective approach to building construction using manufactured or modular building techniques.

SUMMARY

The implementations disclosed herein provide a deployable production facility for producing building modules for use in the construction of buildings and capable of later being redeployed at other locations. A frame is removably mounted to a production floor and is used to support one or more overhead cranes that are positioned over one or more production lines defined on the production floor, and a shelter or cover such as a tent is used to enclose the production line(s), frame and overhead cranes. As desired, the tent, overhead cranes and frame may be disassembled and redeployed at a different site.

Therefore, consistent with one aspect of the invention, a deployable production facility for producing building modules may include a production line including a plurality of stations, an overhead crane positioned over the production line and configured to move building modules between the plurality of stations, a tent including a roof portion and a plurality of sidewall portions and configured to enclose the production line, and a frame supporting the runway of the overhead crane to position the overhead crane over the production line and secured to a production floor. The overhead crane includes a hoist configured to lift and lower a building module supported thereby, a trolley supporting the hoist and configured to move the building module supported by the hoist between the plurality of stations, and a runway extending along and above the plurality of stations to support the trolley, and the frame is further configured to support the roof portion of the tent. The tent is removable from the frame and the frame is removably secured to the production floor for reassembly of the production facility at another location.

Some embodiments may also include a concrete slab, and the production floor is defined on a portion of the concrete slab and the frame is anchored to the concrete slab. Also, in some embodiments, the runway includes first and second substantially parallel runway beams, the overhead crane further includes a bridge extending between the first and second runway beams and movable along the first and second runway beams, and the trolley is supported by the bridge and is movable along the bridge in a generally transverse direction to the first and second runway beams. Further, in some embodiments, the trolley is a first trolley and the hoist is a first hoist, the overhead crane further includes a second hoist supported by a second trolley, and the second trolley is supported by the bridge.

In some embodiments, the first and second hoists are configured to collectively cradle a portion of a building module. In addition, in some embodiments, the portion of the building module is a first portion proximate an end of the building module, the bridge is a first bridge, and the overhead crane further includes a second bridge extending between the first and second runway beams and movable along the first and second runway beams, third and fourth trolleys supported by the second bridge and movable along the second bridge in a generally transverse direction to the first and second runway beams, and third and fourth hoists respectively supported by the third and fourth trolleys, where the third and fourth hoists are configured to collectively cradle a second portion of the building module proximate an opposite end of the building module.

In some embodiments, the building module is a first building module, the first and second bridges, the first, second, third and fourth trolleys, and the first, second, third and fourth hoists form a first budding module crane unit configured to move the first building module between first and second production stations among the plurality of production stations, and the overhead crane further includes a second building module crane unit configured to move a second building module between third and fourth production stations among the plurality of production stations. The second building module crane unit includes third and fourth bridges extending between the first and second runway beams and movable along the first and second runway beams, fifth and sixth trolleys supported by the third bridge and movable along the third bridge in a generally transverse direction to the first and second runway beams, seventh and eighth trolleys supported by the fourth bridge and movable along the fourth bridge in a generally transverse direction to the first and second runway beams, fifth and sixth hoists respectively supported by the fifth and sixth trolleys and configured to collectively cradle a first portion of a second building module proximate an end of the second building module, and seventh and eighth hoists respectively supported by the seventh and eighth trolleys and configured to collectively cradle a second portion of the second building module proximate an opposite end of the second building module.

In addition, in some embodiments, the production line is a first production line, the deployable production facility further includes a second production line running generally parallel to the first production line, and the bridge extends over both of the first and second production lines such that the trolley is movable to enable the hoist to support building modules from either of the first and second production lines. Moreover, in some embodiments, the frame includes a tent support member extending above the runway of the overhead crane and configured to support the tent. Some embodiments may also include one or more office trailers positioned adjacent the tent, and some embodiments may further include one or more rigid framed entrances installed on a sidewall portion of the tent and positioned proximate an end of the production line for use in shipping completed building modules.

Some embodiments may also include one or more staging areas disposed adjacent the plurality of stations of the production facility and configured to stage building materials used to construct the building modules. In addition, some embodiments may also include one or more rigid framed entrances installed on a sidewall portion of the tent and positioned proximate one or more of the staging areas for use in receiving building materials used to construct the building modules. Some embodiments may also include a climate control system installed within the tent.

Some embodiments may further include a power distribution system, and the frame is configured to route at least a portion of cabling for the power distribution system. In addition, some embodiments may further include a plurality of roll-away scaffolds positioned in the plurality of stations, each roll-away scaffold including integrated steps.

Consistent with another aspect of the invention, a method of producing building modules may include constructing a building module within a production line including a plurality of stations, where the production line is disposed within a deployable production facility including a tent including a roof portion and a plurality of sidewall portions and configured to enclose the production line and a frame secured to a production floor and configured to support the roof portion of the tent, and where the tent is removable from the frame and the frame is removably secured to the production floor for reassembly of the production facility at another site, and during construction of the building module, moving the building module between the plurality of stations using an overhead crane positioned over the production line, the overhead crane including a hoist configured to lift and lower the building module, a trolley supporting the hoist and configured to move the building module supported by the hoist between the plurality of stations, and a runway supported by the frame extending along and above the plurality of stations.

Some embodiments may also include, prior to constructing the building module, deploying the deployable production facility, where deploying the deployable production facility includes pouring a concrete slab, where the production floor is defined on a portion of the poured concrete slab, anchoring the frame to the concrete slab, assembling the overhead crane on the frame, and supporting the tent on the frame. In addition, in some embodiments, deploying the deployable production facility is performed at a first site, the method further including, after constructing the building module, disassembling the deployable production facility by disassembling the frame, the overhead crane and the tent, and redeploying the deployable production facility at a second site using the frame, the overhead crane and the tent. Also, in some embodiments, redeploying the deployable production facility includes reconfiguring the frame and the overhead crane to include a different number of production lines and/or stations than were used at the first site.

Consistent with another aspect of the invention, a method of deploying a deployable production facility for constructing building modules may include deploying the deployable production facility at a first site by pouring a concrete slab, where a production floor is defined on a portion of the poured concrete slab, and the production floor includes one or more production lines, each including a plurality of stations, anchoring a frame to the concrete slab, where the frame is removably secured to the production floor for reassembly of the production facility at another site, assembling an overhead crane on the frame such that the overhead crane is positioned over the one or more production lines, the overhead crane including a hoist configured to lift and lower a building module, a trolley supporting the hoist and configured to move the building, module supported by the hoist between the plurality of stations, and a runway supported by the frame and extending along and above the plurality of stations and the one or more production lines, and enclosing the one or more production lines with a tent including a roof portion and a plurality of sidewall portions, including supporting at least a portion of the roof portion of the tent with the frame, disassembling the deployable production facility by disassembling the frame, the overhead crane and the tent, and redeploying the deployable production facility at a second site using the frame, the overhead crane and the tent.

Moreover, in some embodiments, redeploying the deployable production facility includes reconfiguring the frame and the overhead crane to include a different number of production lines and/or stations than were used at the first site.

Consistent with another aspect of the invention, a deployable production facility for producing building modules may include a production line including a plurality of stations, an overhead crane positioned over the production line and configured to move building modules between the plurality of stations, a tent including a roof portion and a plurality of sidewall portions and configured to enclose the production line, and a frame supporting the runway of the overhead crane to position the overhead crane over the production line and secured to a production floor. The overhead crane includes a hoist configured to lift and lower a building module supported thereby, a trolley supporting the hoist and configured to move the building module supported by the hoist between the plurality of stations, and a runway extending along and above the plurality of stations to support the trolley. The tent is removable from the frame and the frame is removably secured to the production floor for reassembly of the production facility at another location.

Consistent with another aspect of the invention, a method of producing building modules may include constructing a building module within a production line including a plurality of stations, where the production line is disposed within a deployable production facility including a tent including a roof portion and a plurality of sidewall portions and configured to enclose the production line and a frame secured to a production floor, and where the tent is removable from the frame and the frame is removably secured to the production floor for reassembly of the production facility at another site, and during construction of the building module, moving the building module between the plurality of stations using an overhead crane positioned over the production line, the overhead crane including a hoist configured to lift and lower the building module, a trolley supporting the hoist and configured to move the building module supported by the hoist between the plurality of stations, and a runway supported b the frame extending along and above the plurality of stations.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example implementations of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
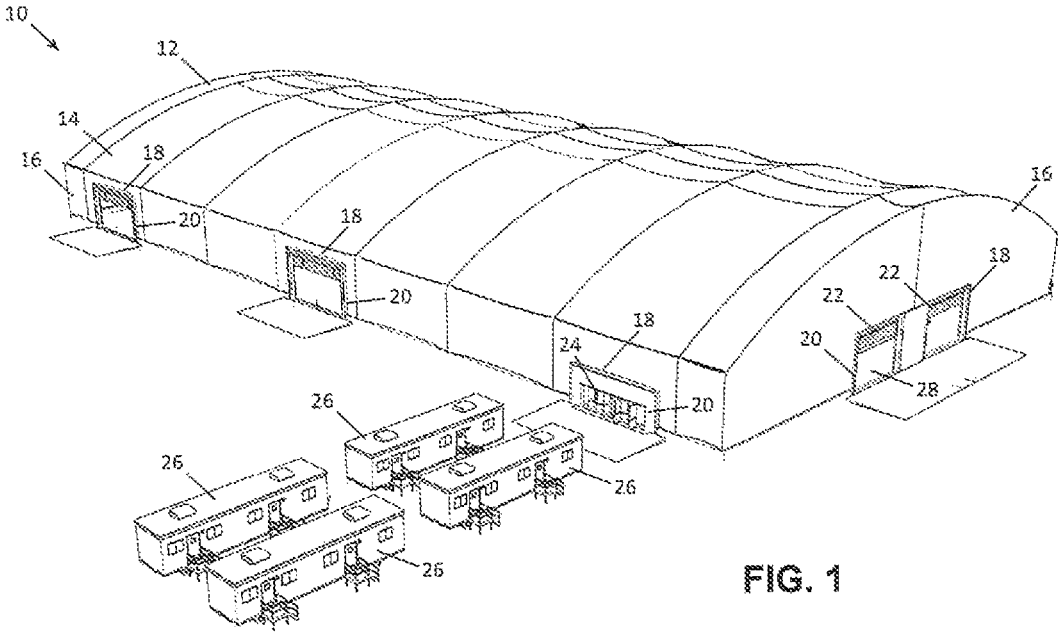
FIG. 1 is a perspective view of an example implementation of a deployable production facility consistent with some embodiments of the invention.

Turning now to the drawings, wherein like numbers denote like parts throughout the several views, FIG. 1 illustrates an deployable production facility 10 in which the various technologies and techniques described herein may be implemented. Deployable production facility 10 may be used in some embodiments to construct building modules that may be assembled together at a building site to form a building or other structure, e.g., a residential building such as a single family home, a multi-family home, an apartment building, etc., a commercial building such as an office building, a retail building, a healthcare facility, a military facility, a manufacturing facility, or practically any other type of structure for which it may be desirable to construct from multiple building modules.

The embodiments discussed hereinafter, for example, will focus on an application in constructing building modules for single family homes, e.g., for placement in residential subdivisions, although the invention is not so limited. It will be appreciated that larger residential subdivisions may include hundreds or even thousands of homes, and moreover, that in many instances these subdivisions are developed on the outskirts of city due to land costs and/or demographic trends. Constructing homes in such developments may take years to complete, as well as the participation by numerous contractors, tradesmen, suppliers, etc. In effect, each lot in a residential, or, commercial development is its own building site, and particularly where lots are developed by different general contractors, each contractor is generally responsible for hiring subcontractors and tradesmen (some of whom may work for multiple contractors), ordering and scheduling delivery of building materials, and managing the overall construction process. On-site construction may also be significantly impacted by climate and weather in some regions, causing significant delays due to rain, snow and/or exceptionally hot or cold weather.

Manufactured, modular and/or prefabricated housing techniques have been employed in some circumstances to attempt to streamline building practices and reduce the amount of on-site construction activities. These techniques can take advantage of greater productivity and efficiency that results from building modules or other construction components at the same location, in a controlled environment, and in greater volumes. In many instances, however, the manufacturing facilities used to build modules or other construction components are located a significant distance from the budding sites in which those components are used. That distance can lead to communication difficulties, which can also lead to unexpected manufacturing costs or delays (or both), often offsetting gains in productivity and efficiency. Due to the high capital costs associated with conventional manufacturing facilities, these facilities are generally sited in locations that are expected to serve customers across large geographical regions for many decades to come.

Embodiments consistent with the invention, on the other hand, address the shortcomings of conventional manufactured, modular and/or prefabricated housing techniques by utilizing a deployable production facility that is capable of being sited nearby a residential development or other building site on a temporary basis, e.g., for months or years rather than decades, and that is, also capable of being broken down and redeployed at a different site in the future. By doing so, a deployable production facility consistent with the invention may be deployed on or at least within a few miles of a development for the duration of the build out of the development, and then removed and deployed to a different location once the build out is complete, thereby minimizing transportation costs while still taking advantage of the productivity and efficiency advantages associated with manufactured, modular and/or prefabricated housing techniques. Further, in some embodiments, a deployable production facility consistent with the invention may be considered to be a temporary, rather than a permanent building structure, and such that activities occurring within the structure may be considered to be construction activities rather than general industry activities from the perspective of the Occupational Safety and Health Administration (OSHA).

In some embodiments consistent with the invention, for example, a deployable production facility may include a production line including a plurality of stations, an overhead crane positioned over the production line and configured to move building modules between the plurality of stations, a shelter or cover such as a tent (hereinafter referred to as a tent) including a roof portion and a plurality of sidewall portions and configured to enclose the production line, and a frame supporting the overhead crane to position the overhead crane over the production line and secured to a production floor. The overhead crane may include a hoist configured to lift and lower a building module supported thereby, a trolley supporting the hoist and configured to move the building module supported by the hoist between the plurality of stations, and a runway extending along and above the plurality of stations to support the trolley. The tent may be removable from the frame and the frame may be removably secured to the production floor for reassembly of the production facility at another location. In addition, in some embodiments, the frame may be configured to support the roof portion of the tent, thereby providing additional stability to the facility.

FIGS. 1-6, for example, illustrate an example implementation of a deployable production facility 10 consistent with some embodiments of the invention. As shown in FIG. 1, for example, facility 10 includes a tent 12 including a roof portion 14 and a plurality of sidewall portions 16, including, for example, end walls and side walls. Tent 12 may have various configurations, including different roof geometries, different support structures, different tent materials, etc. In some embodiments, for example, tent 12 may include a flexible material such as canvas or another man made or natural textile including suitable strength, water resistance, solar resistance, wind resistance, etc., as well as a supporting structure suitable for supporting a tent of such a size. In some embodiments, a double wall construction may be used to provide for insulation and HVAC airflow. In addition, various cutouts 18 may be provided on the sidewall portions 16 to support various rigid framed entrances 20, including, for example, overhead or sliding doors 22 and/or hinged doors 24. Each entrance 20 may be used, for example, to receive building materials used to construct building modules, to ship finished building modules, and to allow for ingress into and egress from the facility. Facility support, including, for example, office space for engineers, managers, and support personnel may be provided, for example, via separate construction trailers 26, similar to a conventional construction site. Trailers 26 may support, for example, architectural, detailing, drafting, scheduling, purchasing, inventory, logistic coordination, supervisory function for production operations, customer tour coordination, human resources, facility safety, facility management, meeting/training facilities, employee lunchrooms and facilities, etc.

Figure 2:
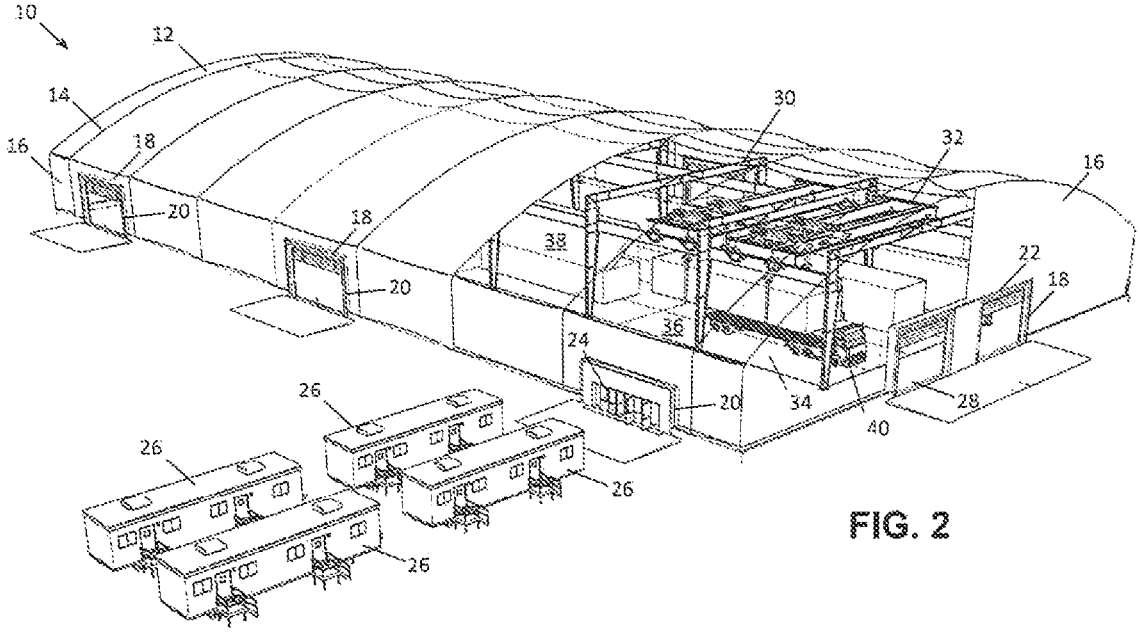
FIG. 2 is a perspective view of the deployable production facility of FIG. 1, with portions of the tent thereof cut away.

With further reference to FIG. 2, a production floor 28 may form the base of facility 10, and may be formed, for example, from poured concrete, e.g., suitable industrial slab with below grade footers along the perimeter and at locations supporting the frame. The slab, or precast slab elements, may be entirely covered by tent 12 in some embodiments, while in other embodiments, the slab may extend beyond tent 12. The slab may also be situated above the ground elevation in some embodiments, with the ground sloping away from the slab for drainage control, and if desired, access ramps disposed adjacent each framed entrance 20.

Figure 3:
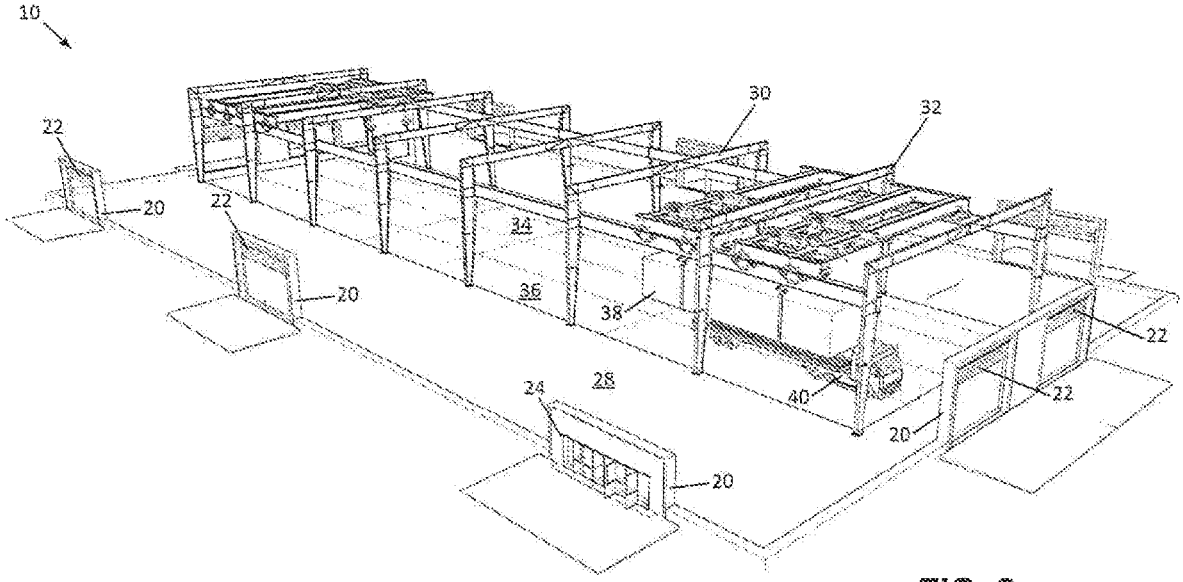
FIG. 3 is a perspective view of the deployable production facility of FIG. 1, with the tent thereof cut away.
Figure 4:
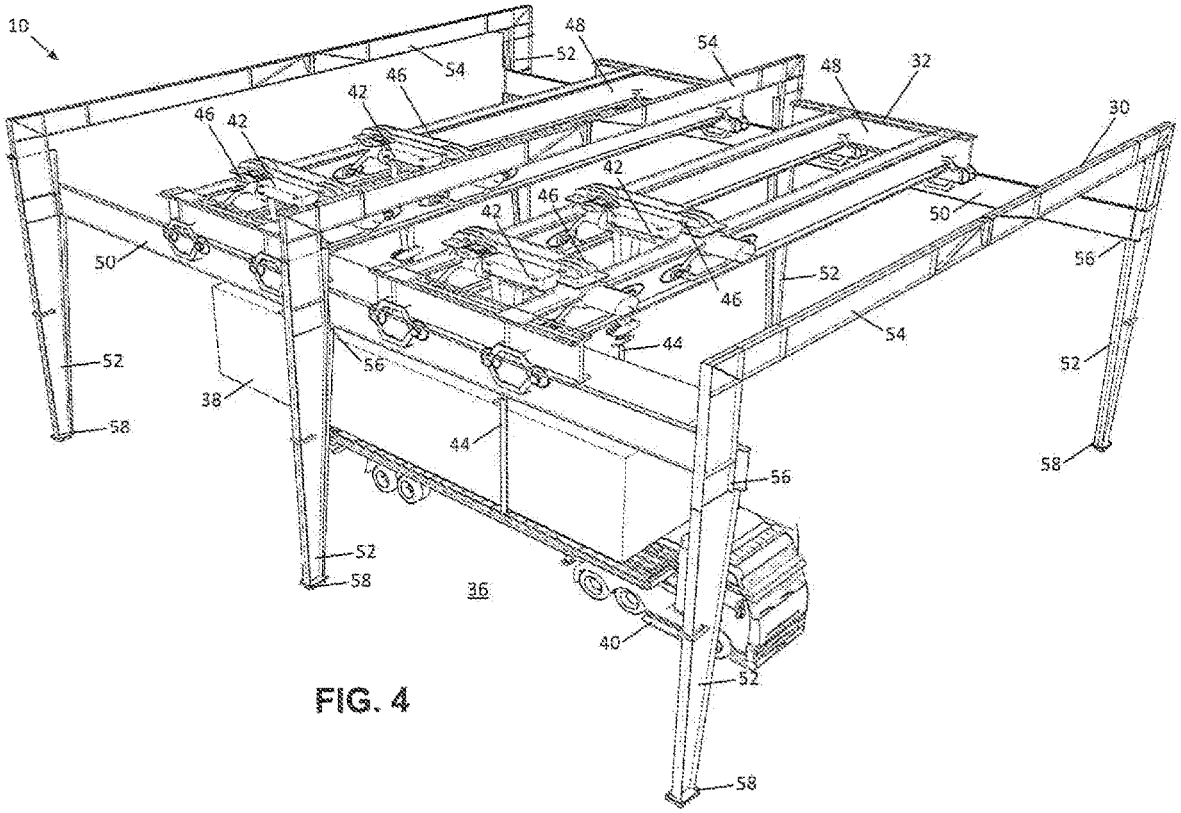
FIG. 4 is an enlarged perspective view of a portion of the frame and overhead crane of the deployable production facility of FIG. 1.

In addition, with further reference to FIGS. 3 and 4, a frame 30 may be supported on the production floor 28 to support one or more overhead cranes 32. Frame 30 is positioned over one or more production lines 34, each including one or more stations 36, and each crane 32 may be used to convey building modules (e.g., building module 38) from station 36 to station 36, and eventually, out of the facility, e.g., by placing a module 38 on a flatbed truck 40 or other suitable vehicle for shipping purposes.

Figure 5:
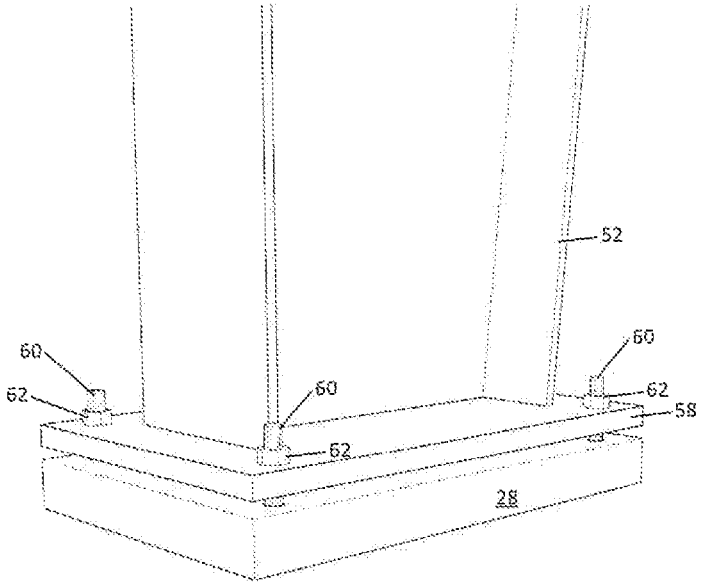
FIG. 5 is an enlarged perspective view of a frame support from the frame depicted in FIG. 4.

While other overhead crane designs may be used in other embodiments, in the illustrated embodiment each overhead crane 32 is configured as a double girder overhead crane with a hoist 42 configured to support a portion of a building module (e.g., via a strap 44), and supported on a trolley 46 that is movable laterally on a double girder bridge 48, with the bridge 48 being movable along a pair of runways 50 supported by frame 30. Frame 30, for example, may include pairs of vertical supports 52 joined by one or more horizontal beams 54 and including saddles 56 for supporting runways 50. Further, as illustrated in FIG. 5, each vertical support 52 may be removably secured to production floor 28 at a base 58 thereof, e.g., via one or more anchor bolts 60 embedded in production floor 28 and associated nuts 62. Other manners of securing the vertical supports 52 to production floor 28 may be used in other embodiments, as will be appreciated by those of ordinary skill in the art having the benefit of the instant disclosure.

Returning to FIGS. 3 and 4, pairs of vertical supports 52 and one or more horizontal beams 54 may form generally U-shaped frame members that constitute the primary structure of frame 30, and may be pre-engineered or bolted together in different embodiments, and in some embodiments, may be capable of being disassembled in order to facilitate transport to a new site whenever the deployable production facility is redeployed at the other site. Further, runways 50 provide additional structural support between adjacent frame members. In other embodiments, different structural configurations may be used, e.g., including additional horizontal supports, additional supports between frame members, etc. The frame may also include various channels and/or brackets to facilitate the routing of electrical cabling, lighting, compressed air distribution, data network, etc.

Also, in the illustrated embodiment, two (2) or a multiple of two (2) overhead cranes 32 (two pairs are shown), each with its own bridge 48, are provided and are configured to work in pairs to lift a module. Spacing between bridges 48 may be variable to support different lengths of modules, and each bridge includes two trolleys 46, with a hoist 42 on each trolley 46 to support different ends of a strap or sling 44 that effectively cradles an end of a building module 38. To lift a module two straps or slings 44 are used, one near each end of the module, and each connects to two hoists, thereby necessitating four hoists per module. It will be appreciated that the overhead crane may be controlled to synchronize the operation of the four hoists such that the hoists run up and down together in a synchronous manner to minimize any listing or heaving of a module. Further, the spacing of trolleys 46 may be set based upon the width of a module, and the movement thereof may be synchronized to maintain the same spacing when moving a module transversely (e.g., between stations in different production lines). Similarly, the spacing of bridges 48 likewise set based upon the length of a module, with movement synchronized to maintain the same spacing when moving modules between stations of a production line.

Figure 6:
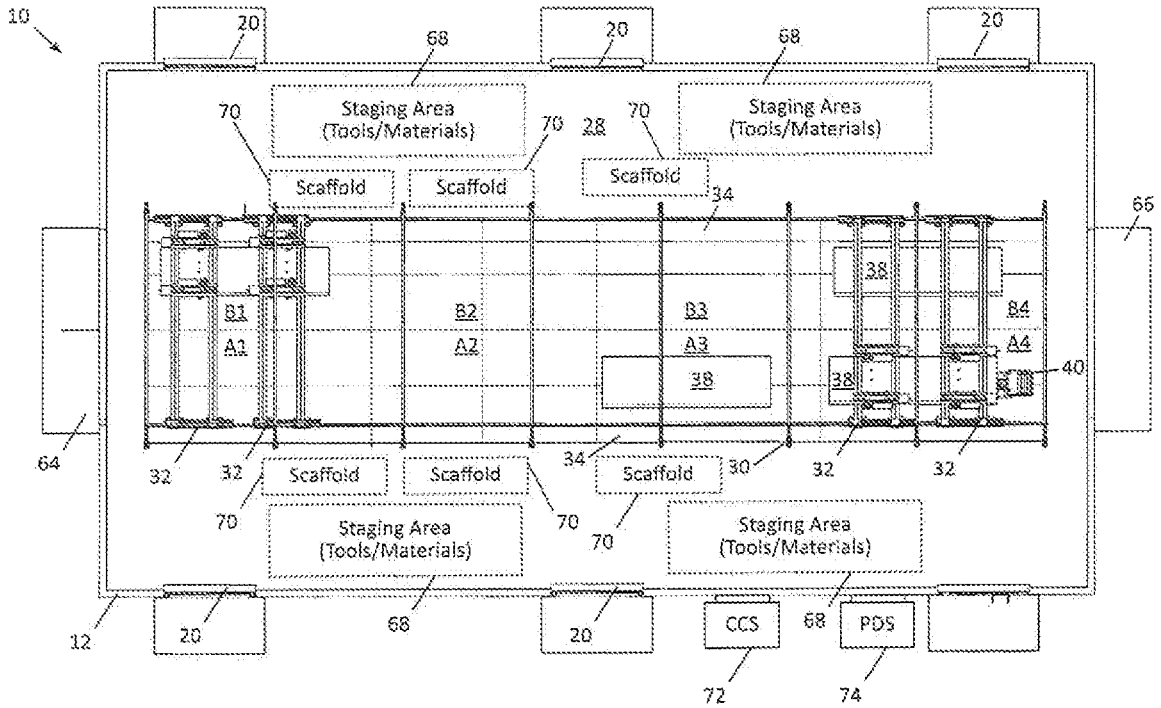
FIG. 6 is a plan view of the deployable production facility of FIG. 1, with the tent thereof cut away.

Furthermore, and with additional reference to FIG. 6, frame 30 and overhead cranes 32 are configured to support a single, or multiple adjacent production lines 34 (two adjacent lines are shown). These lines are also designated in FIG. 6 as lines A and B, each running from a starting location 64 to an ending location 66 with multiple (e.g., four) production stations 36 (also designated as stations A1-A4 and B1-B4). With such a configuration, adjacent staging areas 68 to the stations may be used for the storage of tools, building materials, and other support items, and entrances 20 may be used for receiving new building materials and thereby enable the tools and materials needed for each station to be staged immediately adjacent the station. Each overhead crane 32 also supports both production lines, and in some embodiments, may even be able to move modules between stations of different production lines if desired.

Through the use of overhead cranes and the arrangement of frame 30, it will be appreciated that tracks, rails and other similar structures need not be used on the production floor, and that the ergonomics of the facility are enhanced and the presence of potential hazards is generally reduced. Manual heavy lifting and pushing is greatly reduced, and substantial clearance alongside each building module is provided, enabling, for example, various roil-away scaffolds 70 including integrated steps similar to those used for aircraft to be used in the construction process to minimize the risk of falling. Further, with appropriate climate control, year-round operation is supported, and building materials may be maintained at stable temperatures prior to use.

It will be appreciated that the number of production lines and/or stations may vary in different embodiments, and different frame configurations and numbers and/or configurations of overhead cranes may be used in different embodiments to support different numbers of lines and stations. It is anticipated, for the example as shown, that 6 or 8 modules may be at various stages of construction in the 8 different stations at any given time, and if the residence time of each module is about 5 days, about 7*50=350 modules could be produced in a 50-week year. For single family homes constructed with an average of 5 modules, this would result in the production of about 70 homes per year from such a facility.

An innumerable number of manufacturing processes may be supported, so the invention is not limited to any particular process. Nonetheless, in one example implementation, a production line of four stations may be partitioned as follows:

Station One: construction of floor, framing, and ceiling; rough-in plumbing and electric; placement of module on roll-away jacks (with assistance of overhead crane) to allow access underneath a module for rough-in's (notably eliminating the need for pits).

Station Two: installation of windows, exterior doors, sheetrock, insulation, interior doors, and roof.

Station Three: painting, finishes, tiling, bath and kitchen installation, flooring, trim-out plumbing and electrical, finish carpentry.

Station Four: installation of appliances, testing and validation of electrical and plumbing systems, quality control, punch list fixes, preparation for shipping, and loading onto a truck for delivery.

As noted above, a climate control system may be utilized in facility 10 to allow for year-round operation, as well as to maintain building materials in a controlled climate prior to use. Climate control may be provided in a number of manners in different embodiments, including, for example, using various types of climate control systems such as infrared heating systems, propane or natural gas heating systems, HVAC systems, heat-pumps, chillers, radiators, etc., as represented at 72 in FIG. 6. In addition, various manners of distributing power within a facility using a power distribution system 74 may be used in different embodiments, e.g., by utilizing cabling routed through frame 30, including through pre-engineered supports and/or channels formed in the frame components, and which in some instances may provide power sources for workers from overhead, thereby minimizing the presence of cables running across the production four and presenting potential trip hazards. Lighting may also be implemented in various manners, generally utilizing low voltage light sources such as LED lighting, e.g., supported by the roof portion of tent 12 and/or frame 30.

Figure 7:
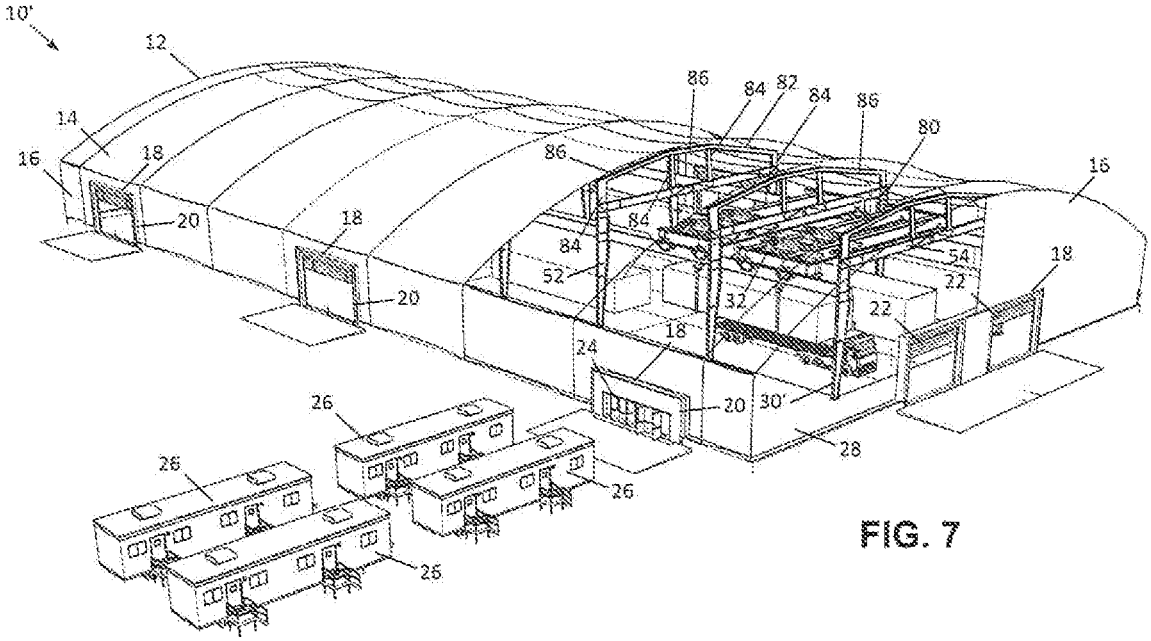
FIG. 7 is a perspective view of another example implementation of a deployable production facility consistent with some embodiments of the invention and including a frame supporting a portion of the tent thereof.

In addition, with reference to FIG. 7, in some embodiments it may be desirable to utilize the overhead crane frame as a structural member for supporting at least a portion of the tent. FIG. 7, in particular, illustrates an alternate deployable production facility 10' that includes a similar tent 12 to that described above in connection with FIGS. 1-6, but that includes a frame 30' that, in addition to supporting one or more overhead cranes 32, additionally supports the roof portion 14 of tent 12. Specifically, in this embodiment, each frame member 80 of frame 30' includes, in addition to a pair of vertical supports 52 and a horizontal beam 54, a tent support member 82 that supports tent 12. While an innumerable number of different structural designs may be used for each frame member 80 and tent support member 82, in the illustrated embodiment of FIG. 7, each tent support member 82 includes four vertical supports 84 that support three horizontally-extending roof supports 86 that generally follow the curvature of roof portion 14 of tent 12. The provision of supporting structure on the frame in some embodiments reinforces the tent while also reducing the amount of support needed along the periphery of tent 12, thereby freeing up space alongside the production lines.

Figure 8:
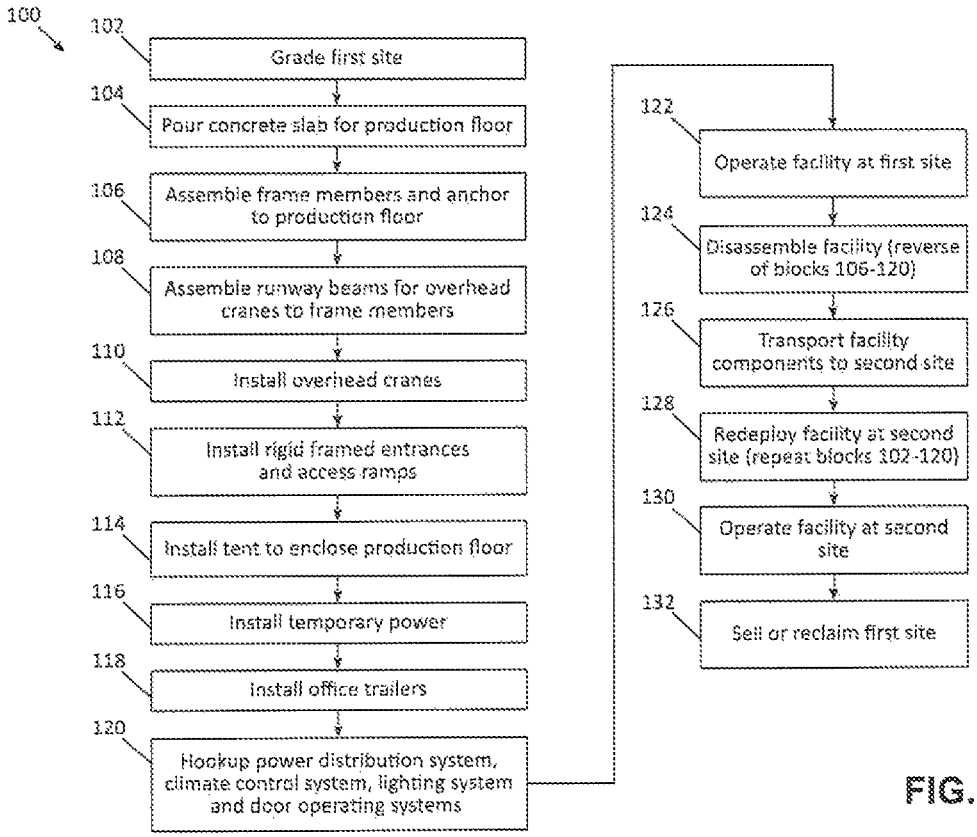
FIG. 8 is a flowchart illustrating a sequence of operations for deploying, disassembling and redeploying a deployable production facility consistent with some embodiments of the invention.

Now turning to FIG. 8, it will be appreciated that a deployable production facility consistent with the invention may be utilize to provide for the production of building modules in various locations relatively proximate to the building sites where the building modules are utilized, thereby minimizing shipping costs, and further enabling the facility to be broken down and redeployed at different locations once developments are fully built out and/or no longer need further production services. FIG. 8, in particular illustrates a sequence of operations 100 for deploying, disassembling, and redeploying a production facility in a manner consistent with some embodiments of the invention. Sequence 100 is in some respects simplified and does not represent each and every step involved in the deployment of a facility; however, additional steps would be understood by those of ordinary skill in the art having the benefit of the instant disclosure. Moreover, it will be appreciated that the steps described hereinafter may be performed in different orders and/or concurrently in some instances.

In block 102, a first site, which is desirably positioned proximate to a construction development that will utilize produced building modules, is graded, and in block 104, a concrete slab is poured to form the production floor for the facility, including footers as needed to support the tent periphery and the frame. In block 106, the frame members are assembled and anchored to the production floor, and in block 108, the runway beams are assembled on the frame members to form the runways for the overhead cranes. In block 110, the overhead cranes are installed on the runway beams, and in block 112, the rigid framed entrances and access ramps therefor are positioned and installed. In block 114, the tent is installed to enclose the production floor, and in some embodiments, with at least a portion of a roof portion of the tent supported by the frame. Thereafter, temporary power may be installed in block 116, and office trailers may be installed in block 118. The various operations systems, e.g., the power distribution system, climate control system, lighting system, door operating systems, etc. may then be hooked up in block 120, along with any other steps needed to ready the facility for production. At this point, the deployable production facility has been deployed at the first site and production operations may then be initiated to produce building modules (block 122).

Months or years after the facility has been deployed, it may be desirable to redeploy the facility at a different site or location, as represented in blocks 124-126. In order to do so, the deployable production facility may be disassembled, e.g., at least by disassembling the frame, the overhead crane and the tent, or otherwise by generally performing blocks 106-120 in reverse. The disassembled facility components may then be transported to a second site or location in block 126, and the facility may be redeployed in block 128, e.g., by repeating blocks 102-120 at the second site. It will also be appreciated that, at this time, the frame and/or overhead cranes may be reconfigured to support a different number of production lines and/or stations if desired, and moreover, some facility components may be reused or replaced, e.g., to replace a tent with a larger or smaller tent, to add or remove frame components and/or overhead cranes to support different lengths or numbers of production lines and/or stations, etc.

Thereafter, the redeployed facility may be operated at the second site (block 130), and if desired, redeployed at a different site in the future. Moreover, as illustrated in block 132, the original site may retain a relatively small footprint from the original facility, mostly the concrete slab poured for the production floor, and may be converted to other uses, sold off for other uses, or reclaimed for other uses.

While particular implementations have been described, is not intended that the invention be limited thereto, as it is intended that the invention be as broad in scope as the art will allow and that the specification be read likewise. It will therefore be appreciated by those skilled in the art that yet other modifications could be made without deviating from its spirit and scope as claimed.

What is claimed is:

1. A deployable production facility for producing building modules, comprising:

a production line including a plurality of stations;

an overhead crane positioned over the production line and configured to move building modules between the plurality of stations, the overhead crane including:

a hoist configured to lift and lower a building module supported thereby;

a trolley supporting the hoist and configured to move the building module supported by the hoist between the plurality of stations; and a runway extending along and above the plurality of stations to support the trolley;

a tent including a roof portion and a plurality of sidewall portions and configured to enclose the production line; and a frame supporting the runway of the overhead crane to position the overhead crane over the production line and secured to a production floor, the frame further configured to support the roof portion of the tent;

wherein the tent is removable from the frame and the frame is removably secured to the production floor for reassembly of the production facility at another location;

wherein the runway includes first and second substantially parallel runway beams, wherein the overhead crane further comprises a bridge extending between the first and second runway beams and movable along the first and second runway beams, and wherein the trolley is supported by the bridge and is movable along the bridge in a generally transverse direction to the first and second runway beams;

one or more rigid framed entrances installed on a sideman portion of the tent; and, one or more staging areas disposed adjacent the plurality of stations of the production facility and configured to stage building materials used to construct the building modules, wherein the trolley is a first trolley and the hoist is a first hoist, wherein the overhead crane further comprises a second hoist supported by a second trolley, and wherein the second trolley is supported by the bridge, and wherein the first and second hoists are configured to collectively cradle a portion of a building module, and wherein the portion of the building module is a first portion proximate an end of the buildina module, wherein the bridge is a first bridge, and wherein the overhead crane further comprises:

a second bridge extending between the first and second runway beams and movable along the first and second runway beams;

third and fourth trolleys supported by the second bridge and movable along the second bridge in a generally transverse direction to the first and second runway beams; and third and fourth hoists respectively supported by the third and fourth trolleys, wherein the third and fourth hoists are configured to collectively cradle a second portion of the building module proximate an opposite end of the building module.

2. The deployable production facility of claim 1, further comprising a concrete slab, wherein the production floor is defined on a portion of the concrete slab and the frame is anchored to the concrete slab.

3. The deployable production facility of claim 1, wherein the building module is a first building module, wherein the first and second bridges, the first, second, third and fourth trolleys, and the first, second, third and fourth hoists form a first building module crane unit configured to move the first building module between first and second production stations among the plurality of production stations, and wherein the overhead crane further comprises a second building module crane unit configured to move a second building module between third and fourth production stations among the plurality of production stations, the second building module crane unit comprising:

third and fourth bridges extending between the first and second runway beams and movable along the first and second runway beams;

fifth and sixth trolleys supported by the third bridge and movable along the third bridge in a generally transverse direction to the first and second runway beams;

seventh and eighth trolleys supported by the fourth bridge and movable along the fourth bridge in a generally transverse direction to the first and second runway beams;

fifth and sixth hoists respectively supported by the fifth and sixth trolleys and configured to collectively cradle a first portion of a second building module proximate an end of the second building module; and seventh and eighth hoists respectively supported by the seventh and eighth trolleys and configured to collectively cradle a second portion of the second building module proximate an opposite end of the second building module.

4. The deployable production facility of claim 1, wherein the production line is a first production line, wherein the deployable production facility further comprises a second production line running generally parallel to the first production line, and wherein the bridge extends over both of the first and second production lines such that the trolley is movable to enable the hoist to support building modules from either of the first and second production lines.

5. The deployable production facility of claim 1, wherein the frame includes a tent support member extending above the runway of the overhead crane and configured to support the tent.

6. The deployable production facility of claim 1, further comprising one or more office trailers positioned adjacent the tent.

7. The deployable production facility of claim 1, wherein said one or more rigid framed entrances is positioned proximate an end of the production line for use in shipping completed building modules.

8. The deployable production facility of claim 1, further comprising a climate control system installed within the tent.

9. The deployable production facility of claim 1, further comprising a power distribution system, wherein the frame is configured to route at least a portion of cabling for the power distribution system.

10. The deployable production facility of claim 1, further comprising a plurality of roll-away scaffolds positioned in the plurality of stations, each roll-away scaffold including integrated steps.

11. A method of producing building modules, the method comprising:

constructing a building module within a production line including a plurality of stations, wherein the production line is disposed within a deployable production facility comprising a tent including a roof portion and a plurality of sidewall portions and configured to enclose the production line and a frame secured to a production floor and configured to support the roof portion of the tent, wherein the tent is removable from the frame and the frame is removably secured to the production floor for reassembly of the production facility at another site; and during construction of the building module, moving the building module between the plurality of stations using an overhead crane positioned over the production line, the overhead crane comprising a hoist configured to lift and lower the building module, a trolley supporting the hoist and configured to move the building module supported by the hoist between the plurality of stations, and a runway supported by the frame extending along and above the plurality of stations.

12. The method of claim 11 further comprising, prior to constructing the building module, deploying the deployable production facility, wherein deploying the deployable production facility includes:

pouring a concrete slab, wherein the production floor is defined on a portion of the poured concrete slab;

releasably anchoring the frame to the concrete slab;

assembling the overhead crane on the frame; and supporting the tent on the frame.

13. The method of claim 12, wherein deploying the deployable production facility is performed at a first site, the method further comprising, after constructing the building module:

disassembling the deployable production facility by disassembling the frame, the overhead crane and the tent; and redeploying the deployable production facility at a second site using the frame, the overhead crane and the tent.

14. The method of claim 13, wherein redeploying the deployable production facility includes reconfiguring the frame and the overhead crane to include a different number of production lines and/or stations than were used at the first site.

15. A method of deploying a deployable production facility for constructing building modules, the method comprising:

deploying the deployable production facility at a first site by:

pouring a concrete slab that defines a production floor, and wherein the production floor includes one or more production lines, each including a plurality of stations;

anchoring a frame to the concrete slab, wherein the frame is removably secured to the production floor for reassembly of the production facility at a second site;

assembling an overhead crane on the frame such that the overhead crane is positioned over the one or more production lines, said overhead crane configured to move a building module between the plurality of stations, the overhead crane comprising a hoist configured to lift and lower a the building module, a trolley supporting the hoist and configured to move the building module supported by the hoist between the plurality of stations, and a runway supported by the frame and extending along and above the plurality of stations and the one or more production lines; and enclosing the one or more production lines with a tent including a roof portion and a plurality of sidewall portions, including supporting at least a portion of the roof portion of the tent with the frame;

disassembling the deployable production facility by disassembling the frame, the overhead crane and the tent; and, redeploying the deployable production facility at the second site using the frame, the overhead crane and the tent.

16. The method of claim 15, wherein redeploying the deployable production facility includes reconfiguring the frame and the overhead crane to include a different number of production lines and/or stations than were used at the first site.

17. A method of producing building modules, the method comprising:

constructing a building module within a production line including a plurality of stations, wherein the production line is disposed within a deployable production facility comprising a tent including a roof portion and a plurality of sidewall portions and configured to enclose the production line and a frame secured to a production floor, wherein the tent is removable from the frame and the frame is removably secured to the production floor for reassembly of the production facility at another site; and during construction of the budding module, moving the building module between the plurality of stations using an overhead crane positioned over the production line, the overhead crane comprising a hoist configured to lift and lower the building module, a trolley supporting the hoist and configured to move the building module supported by the hoist between the plurality of stations, and a runway supported by the frame extending along and above the plurality of stations.

* * * * *